US006446958B1

(12) United States Patent
Sette et al.

(10) Patent No.: US 6,446,958 B1
(45) Date of Patent: Sep. 10, 2002

(54) METHOD AND SYSTEM FOR DIRECTING AN ITEM THROUGH THE FEED PATH OF A FOLDING APPARATUS

(75) Inventors: Paul R. Sette, Branford; Richard A. Sloan, Jr., Southbury, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/442,559

(22) Filed: Nov. 18, 1999

(51) Int. Cl.[7] ..... B65H 5/00

(52) U.S. Cl. ..... 271/225; 271/186; 271/902; 493/416

(58) Field of Search ..... 271/225, 65, 184, 271/186, 902; 493/416, 419, 420; 156/442.1

(56) References Cited

U.S. PATENT DOCUMENTS

| | | | | |
|---|---|---|---|---|
| 1,813,476 A | | 7/1931 | Waterworth | 493/419 |
| 2,594,316 A | | 4/1952 | Krueger et al. | 216/23 |
| 3,265,382 A | | 8/1966 | Sherman | 270/45 |
| 3,436,294 A | | 4/1969 | Marano | 156/351 |
| 3,527,635 A | | 9/1970 | Paulsen et al. | 156/361 |
| 3,535,186 A | | 10/1970 | DeLaCoussaye | 156/355 |
| 4,003,780 A | | 1/1977 | Cohn | 156/519 |
| 5,082,272 A | * | 1/1992 | Xydias et al. | 271/186 |
| 5,088,712 A | | 2/1992 | Luperti | 270/95 |
| 5,192,389 A | | 3/1993 | Martin | 156/364 |
| 5,196,083 A | | 3/1993 | Baker et al. | 156/364 |
| 5,279,698 A | | 1/1994 | Davis | 156/483 |
| 5,281,296 A | | 1/1994 | Beliveau | 156/542 |
| 5,310,174 A | * | 5/1994 | Thomas | 271/225 |
| 5,338,387 A | | 8/1994 | Noll | 156/441.5 |
| 5,417,783 A | | 5/1995 | Boreali et al. | 156/64 |
| 5,441,244 A | | 8/1995 | Bartoes et al. | 270/45 |
| 5,449,166 A | | 9/1995 | Lohmann et al. | 271/225 |
| 5,482,593 A | | 1/1996 | Kuhn et al. | 156/521 |
| 5,514,066 A | | 5/1996 | Monaco | 493/25 |
| 5,520,603 A | | 5/1996 | Bluthardt et al. | 493/421 |
| 5,547,175 A | | 8/1996 | Graushar et al. | 270/37 |
| 5,690,325 A | * | 11/1997 | Morimoto | 271/65 |
| 5,711,846 A | | 1/1998 | Alicea | 156/556 |
| 5,735,101 A | | 4/1998 | Lam | 53/136.1 |
| 5,768,959 A | | 6/1998 | Lorenzo | 83/74 |
| 5,769,774 A | | 6/1998 | Beck et al. | 493/421 |
| 5,785,638 A | | 7/1998 | Bristo et al. | 493/420 |
| 5,802,808 A | | 9/1998 | Lyga | 53/381.5 |
| 5,813,327 A | | 9/1998 | Freeman et al. | 101/93 |
| 5,816,570 A | | 10/1998 | Paradis et al. | 271/179 |
| 5,816,715 A | | 10/1998 | Harman et al. | 400/71 |

(List continued on next page.)

OTHER PUBLICATIONS

U.S. application No. 09/442,561, entitled "A Method And System For Folding And Tabbing Sheets", filing date: Nov. 18, 1999.

U.S. application No. 09,442,552, entitled "Method And System For Tabbing Folded Material", filing date: Nov. 18, 1999.

*Primary Examiner*—Joseph E. Valenza
*Assistant Examiner*—Mark A. Deuble
(74) *Attorney, Agent, or Firm*—George M. Macdonald; Angelo N. Chaclas

(57) ABSTRACT

A method and an apparatus for controlling the traveling direction of a piece of folded material in the feed path of a folding machine. A first roller nip is used to ingest the folded material into the front end of a turn chute. If the traveling direction is to be maintained, the folded material is allowed to move out through the rear end of the turn chute. If the traveling direction is to be reversed, a stop is used to block the rear end in order to keep the leading edge of the ingested folded material from leaving the turn chute through the rear end. At the same time, the trailing edge of the ingested folded material is caused to engage in a second roller nip located in the front end of the turn chute, in order for the second roller nip to move the folded material out of the turn chute, thereby reversing the traveling direction of the folded material.

9 Claims, 7 Drawing Sheets

U.S. PATENT DOCUMENTS

| | | | | | |
|---|---|---|---|---|---|
| 5,818,724 | A | | 10/1998 | Brewster, Jr. et al. | 364/478.08 |
| 5,833,232 | A | | 11/1998 | Ifkovits et al. | 271/225 |
| 5,887,868 | A | * | 3/1999 | Lambert et al. | 271/186 |
| 6,006,210 | A | | 12/1999 | Freeman et al. | 705/402 |
| 6,090,034 | A | | 7/2000 | Jaksch | 493/478 |
| 6,206,817 | B1 | | 3/2001 | Sette et al. | 493/421 |
| 6,244,590 | B1 | * | 6/2001 | Williams | 271/184 |
| 6,244,591 | B1 | * | 6/2001 | Paulat | 271/225 |

* cited by examiner

METHOD AND SYSTEM FOR DIRECTING AN ITEM THROUGH THE FEED PATH OF A FOLDING APPARATUS

CROSS REFERENCE TO RELATED APPLICATIONS

Reference is made to application Ser. No. 09/442,552, entitled METHOD AND SYSTEM FOR TABBING FOLDED MATERIAL, assigned to the assignee of this application and filed on even date herewith.

Reference is made to application Ser. No. 09/442,561, entitled METHOD AND SYSTEM FOR FOLDING AND TABBING SHEETS, assigned to the assignee of this application and filed on even date herewith.

Reference is made to application Ser. No. 09/442,551, entitled METHOD AND APPARATUS FOR FOLDING SHEETS, assigned to the assignee of this application and filed on even date herewith.

TECHNICAL FIELD

The present invention is generally related to a self mailing apparatus and, more specifically, to an apparatus for controlling the traveling direction of a piece of folding material exiting a folding machine.

BACKGROUND OF THE INVENTION

A self-mailer is conventionally defined as a mailpiece without an envelope. The mailer usually contains one or more sheets of printed material, folded once or twice by a folding machine into a smaller piece for mailing, The folded material has a folded end and an open end. The open end is sealed with one or more tabs before the self-mailer is sent to the addressee. In addition, it may be required for an address label and a postage stamp or indicia to be applied to or printed on the folded material. Thus, the components of a commercially available equipment for self mailers can generally be grouped into a printer, a folding machine, a labeler and a tabbing device.

Folding machines are generally designed for folding enclosure material to be inserted into envelopes in an envelope inserting device. Thus, when a piece of folded material folded by such a machine exits the machine, it travels in the direction of the fold. This means that the folded end of the folded material is traveling first and the open end is trailing. While this traveling direction of the folded material is desirable when the folded material is to be inserted into an envelope in an envelope inserting device, it is not suitable for tabbing.

In a conventional tabbing device, the tab is facing an incoming piece of folded material so that the tab can be applied to the leading edge of the folded material. Furthermore, the tab must be applied to the open end of the folded material. Thus, when a piece of folded material is fed to a tabbing device, the leading edge of the folded material must be the open end, and not the folded end. In that case, the folded material exiting a folding machine must be rotated by hand or by other means to reverse its the traveling direction, before the folded material is fed to the tabbing device for tabbing.

It is advantageous and desirable to provide a method and an apparatus for directing a piece of folded material through the feed path of a folding machine such that the traveling direction of the folded material is corrected according to whether the folded material is intended for tabbing or for envelope insertion.

SUMMARY OF THE INVENTION

The present invention provides a method and an apparatus for directing a piece of folded material through the feed path of a folding machine in order to correct the traveling direction of the folded material according to the requirement for tabbing or for envelope insertion, wherein the normal traveling direction of the folded material in the feed path of the folding machine is the folded end leading the open end. Thus, for envelope insertion, the traveling direction of the folded material in the feed path of the folding machine is kept unchanged. For tabbing, however, the traveling direction must be reversed so that when the folded material exits the feed path of the folding machine, its open end leads the folded end.

The apparatus, according to the present invention, is operable in a first mode to maintain the traveling direction of a piece of folded material, and in a second mode to reverse the traveling direction, the apparatus includes: a turn chute having a front end and an opposing rear end, a first side and an opposing second side located between the front end and the rear end, wherein the first side and the second side define a front gap at the front end and a rear gap at the rear end; a first nip located at the first gap adjacent the first side of the turn chute for ingesting the folded material into the turn chute through the first gap with the folded end of the folded material leading the open end; a stop located at the rear end of the turn chute, wherein the stop is moved away from the second gap when the apparatus is operated in the first mode in order to allow the ingested folded material to move out of the turn chute through the second gap, and wherein the stop blocks the second gap when the apparatus is operated in the second mode in order to keep the folded end of the ingested folded material from moving out of the second gap; a second nip located at the first gap adjacent the second side of the turn chute; and means for urging the open end of the ingested folded material to move toward to second nip after the folded material has been moved into the turn chute and become disengaged from the first nip so as to cause the open end of the ingested folded material to be engaged with the second nip when the apparatus is operated in the second mode in order for the second nip to move the ingested folded material out of the turn chute with the open end leading the folded end.

Accordingly, in a feed path of a folding machine, a piece of folded material having a folded end and an opposing open end moves in a traveling direction with the folded end leading the open end, the method of reversing the traveling direction of the folded material includes the steps of: ingesting the folded material by a first nip into a turn chute with the folded end leading the open end; stopping the ingested folded material at the folded end by a stopper; disengaging the ingested folded material from the first nip; urging the open end of the ingested folded material to move toward a second nip; causing the open end of the ingested folded material to be engaged in a second nip; and transporting the ingested folded material out of the turn chute by the second nip with the open end leading the folded end.

The present invention will become more apparent upon reading the description taken in conjunction with FIG. 1 to FIG. 3D.

DETAILED DESCRIPTION

Figure 1:
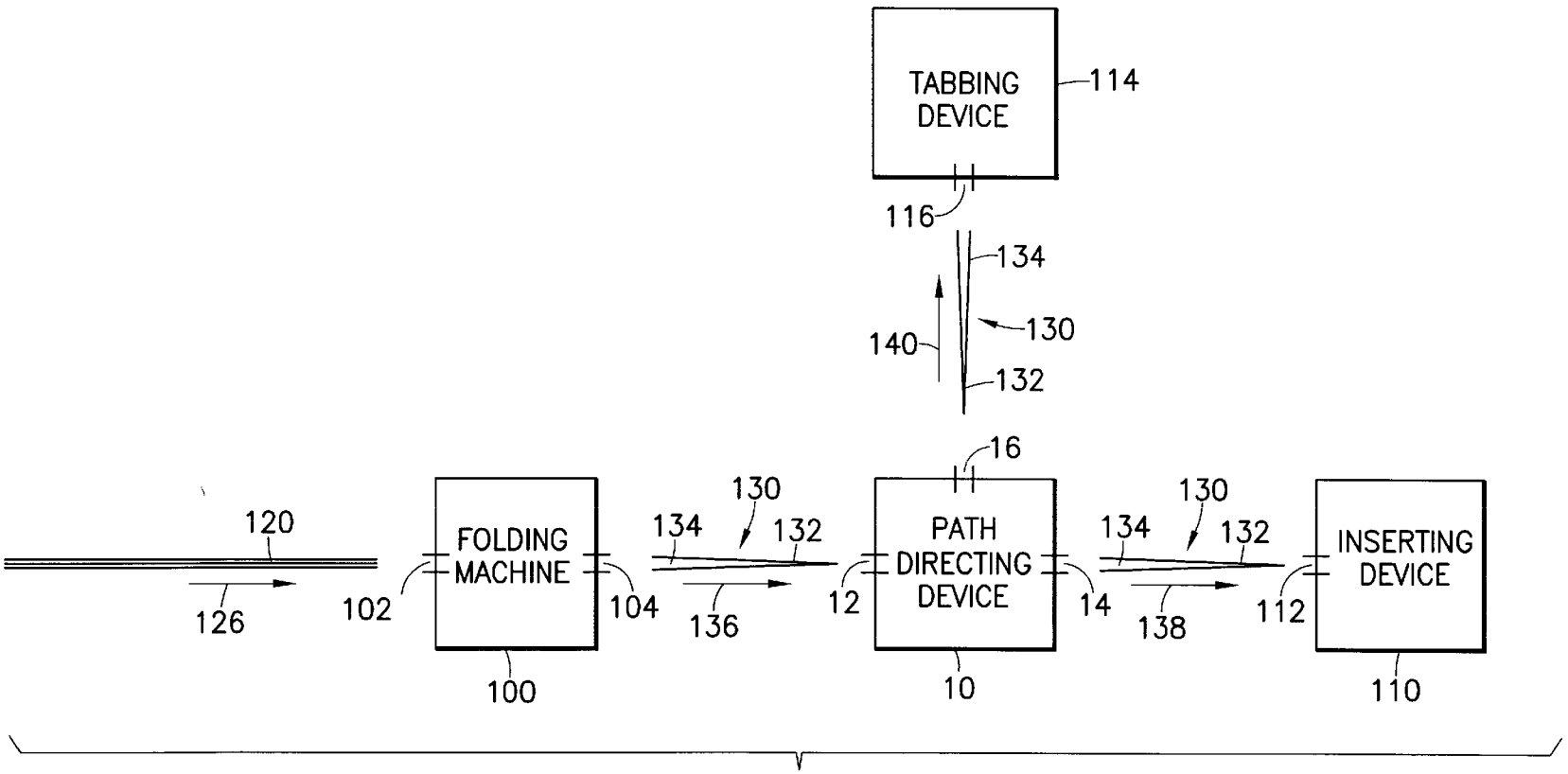
FIG. 1 is a block diagram showing the various paths of a piece of folded material through a folding machine and a path directing apparatus.

As shown in FIG. 1, a folding machine 100 is used to fold one or more sheets of unfolded material 120 into a piece of folded material 130, which is either directed to a tabbing device 110 for sealing or to an inserting device 114 for envelope insertion. The unfolded material 120 enters through an entrance 102 of the folding machine 100 along a moving direction 126. After emerging from an exit 104 of the folding machine 100, the unfolded material 120 becomes folded and moves along a path denoted by arrow 136. At this stage the folded material 130 is traveling with its folded end 132 first and the open end 134 trailing. The folded material 130 is fed into a path directing apparatus 10 through an entrance 12. If the folded material 130 is intended to be inserted in an envelope in the inserting device 110, it is directed by the path directing apparatus 10 to exit through a first exit 14 along path 138. The traveling direction of the folded material 130 remains unchanged. If the folded material 130 is intended to be tabbed in the tabbing device 114, it is directed by the path directing apparatus 10 to exit through a second exit 16, along a path denoted by arrow 140. Now its traveling direction has reversed and he folded material 130 is moving with its open end 134 leading its folded end 132.

Figure 2:
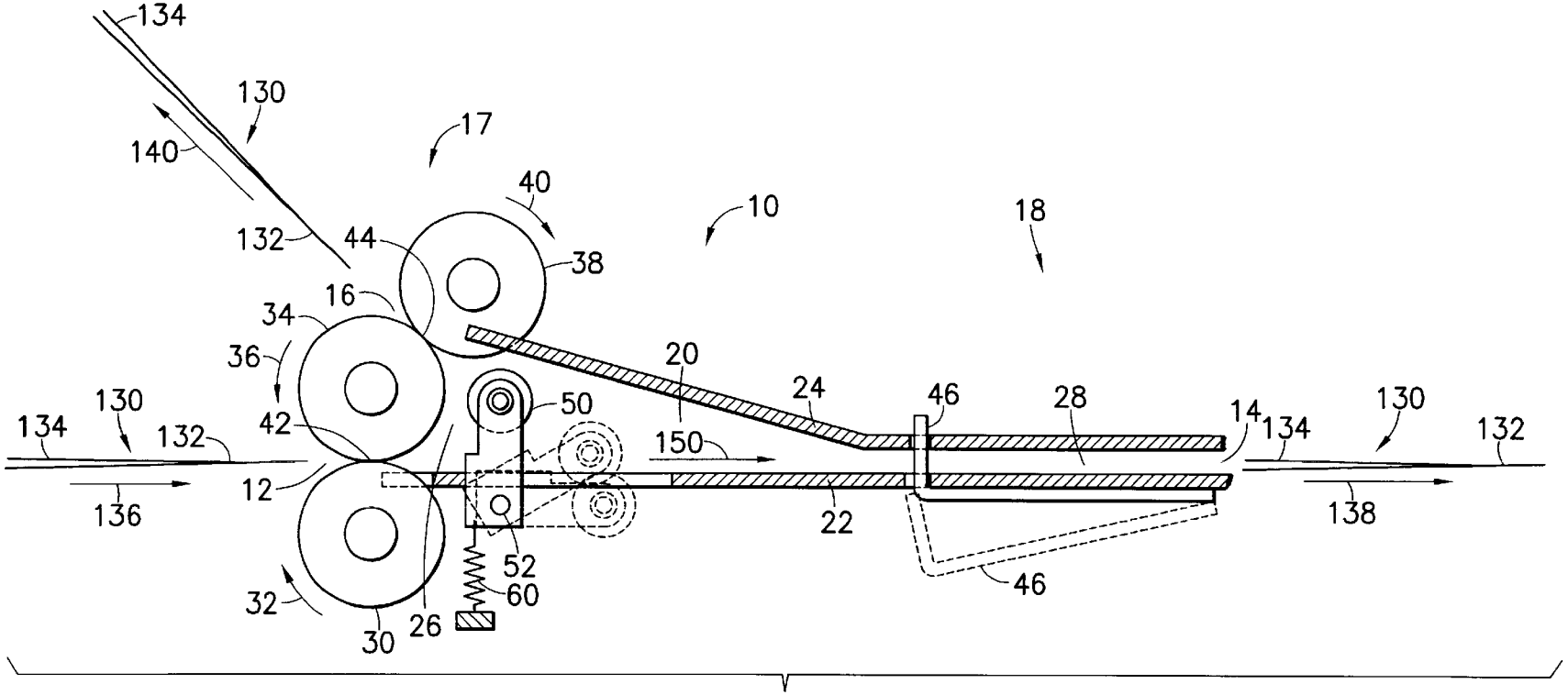
FIG. 2 is a side view of the apparatus for controlling the traveling direction of a piece of folded material according to the present invention.

Now referring to FIG. 2, the path directing apparatus 10 has a front end 17 and a rear end 18, a lower plate 22 and an upper plate 24 located between the front end 17 and the rear end 18 to form a turn chute 20 having a front gap 26 and a narrower rear gap 28. A stop 46 is removably and adjustably mounted near the rear end 18. At the front gap 26, a lower roller 30 and an upper roller 34 are used to form an ingesting nip 42. The lower roller 30 rotates in a clockwise direction as indicated by arrow 32 while the upper roller 34 rotates in an opposite direction as indicated by arrow 36. The ingesting nip 42 is used to ingest a piece of folded material 130 moving along a direction 136 and entering the entrance end 12 of the path directing device 10. When the folded material 130 is moved into the turn chute 20, its folded edge 132 travels approximately along a path 150. In a first operating mode, the apparatus 10 allows an ingested folded material to exit the turn chute without changing its traveling direction. In that case, the stop 46 is moved away from the second gap 28, as shown in broken lines, allowing the folded material to exit through exit end 14 and moves along path 138. In a second operating mode, the apparatus 10 reverses the traveling direction of an ingested folded material before allowing the ingested folded material to exit the turn chute. In that case, the stop 46 is moved into the gap 28, as shown in solid lines. Preferably, the location of the stop 46 is adjustable to accommodate the length of the folded material 130 such that the distance between the ingesting nip 42 and the stop 46 is slightly smaller than the length of the folded material 130, so that when a piece of folded material has entered the turn chute 20 and its leading edge is stopped by the stop 46, it becomes buckled, as shown in FIG. 3C.

At the front gap 26 adjacent the upper plate 24, a reverse roller 38 rotating in a clockwise direction as indicated by arrow 40 is used to form an exiting nip 44 together with the upper roller 34, for moving an ingested folded material out of the turn chute 20 at the exit end 16 of the path directing apparatus 10 along path 140. As shown, when the folded material 130 exits the turn chute 20 through exit end 16, its open end 134 leads the folded end 132. Within the turn chute 20, a spring loaded roller 50 is pivotably mounted at pivot 52 for changing the position of an ingested folded material as shown in FIGS. 3C and 3D. The roller 50 can be depressed by the leading edge of an ingested folded material and move away from the moving path 150, as shown in FIG. 3B. Preferably, a return spring 60 is used to urge the roller 50 to return to its original position when it is not depressed by the leading edge of an ingested folded material, as shown in FIGS. 3A and 3D.

Figure 3A:
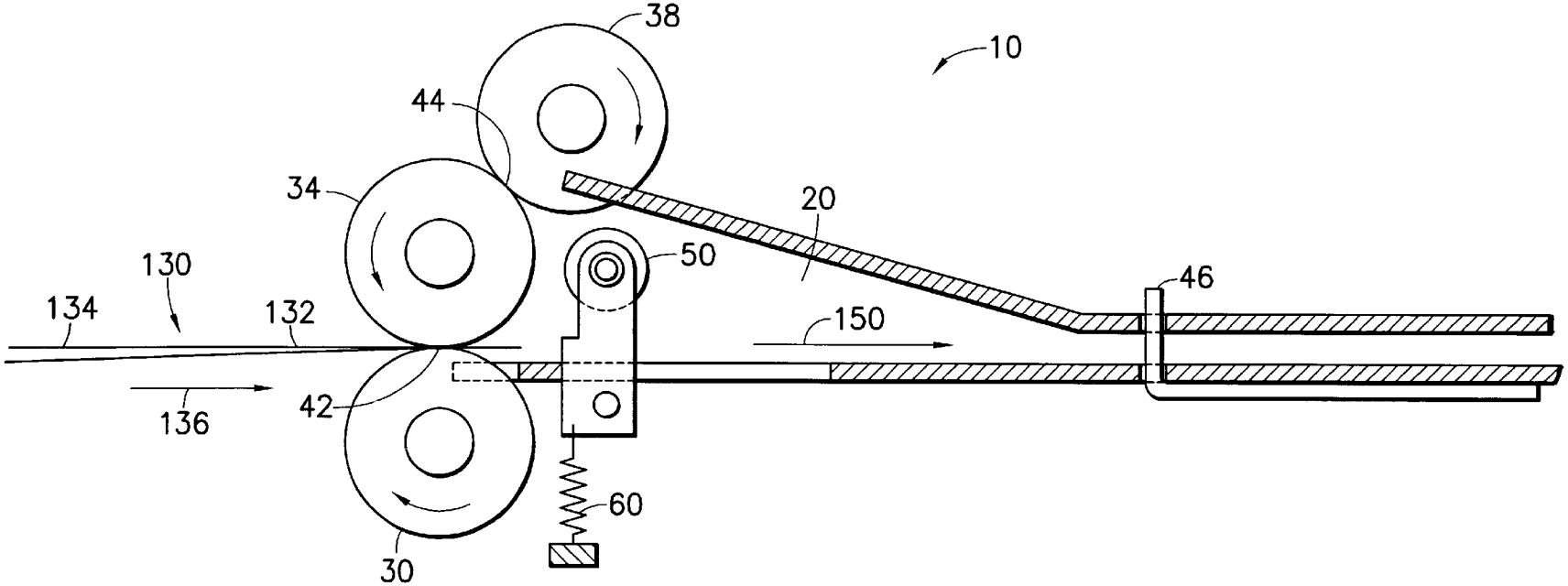
FIGS. 3A through 3E are views similar to FIG. 2 for illustrating the operating principal of the path directing apparatus of FIG. 2.
Figure 3B:
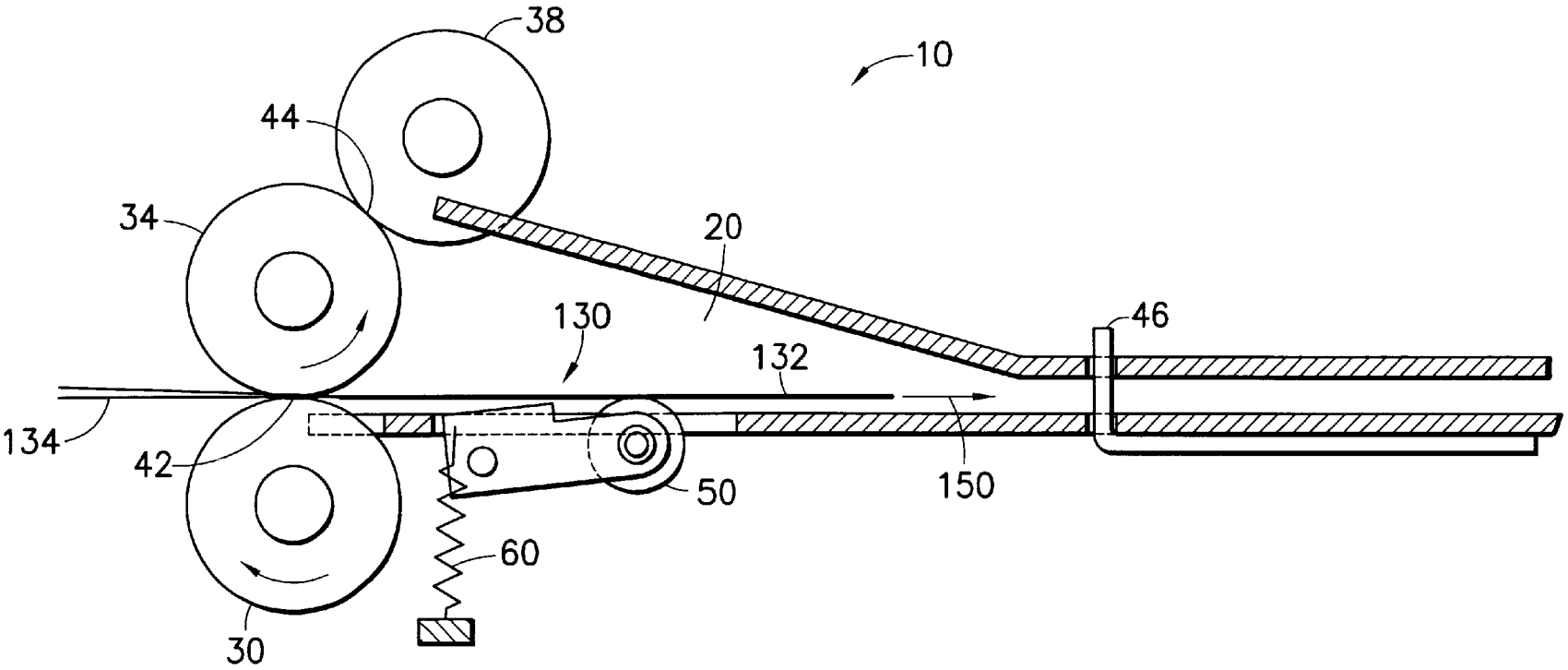
Figure 3C:
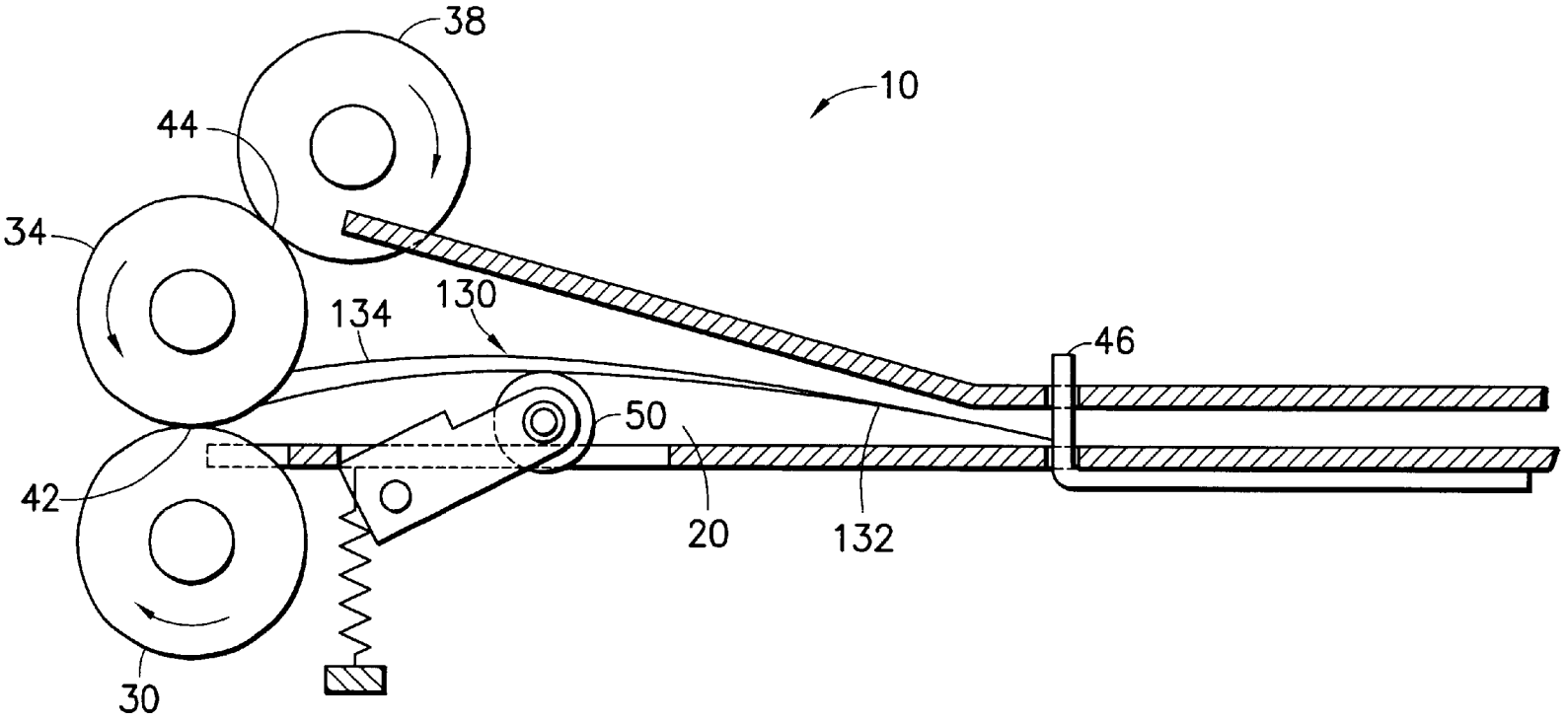
Figure 3D:
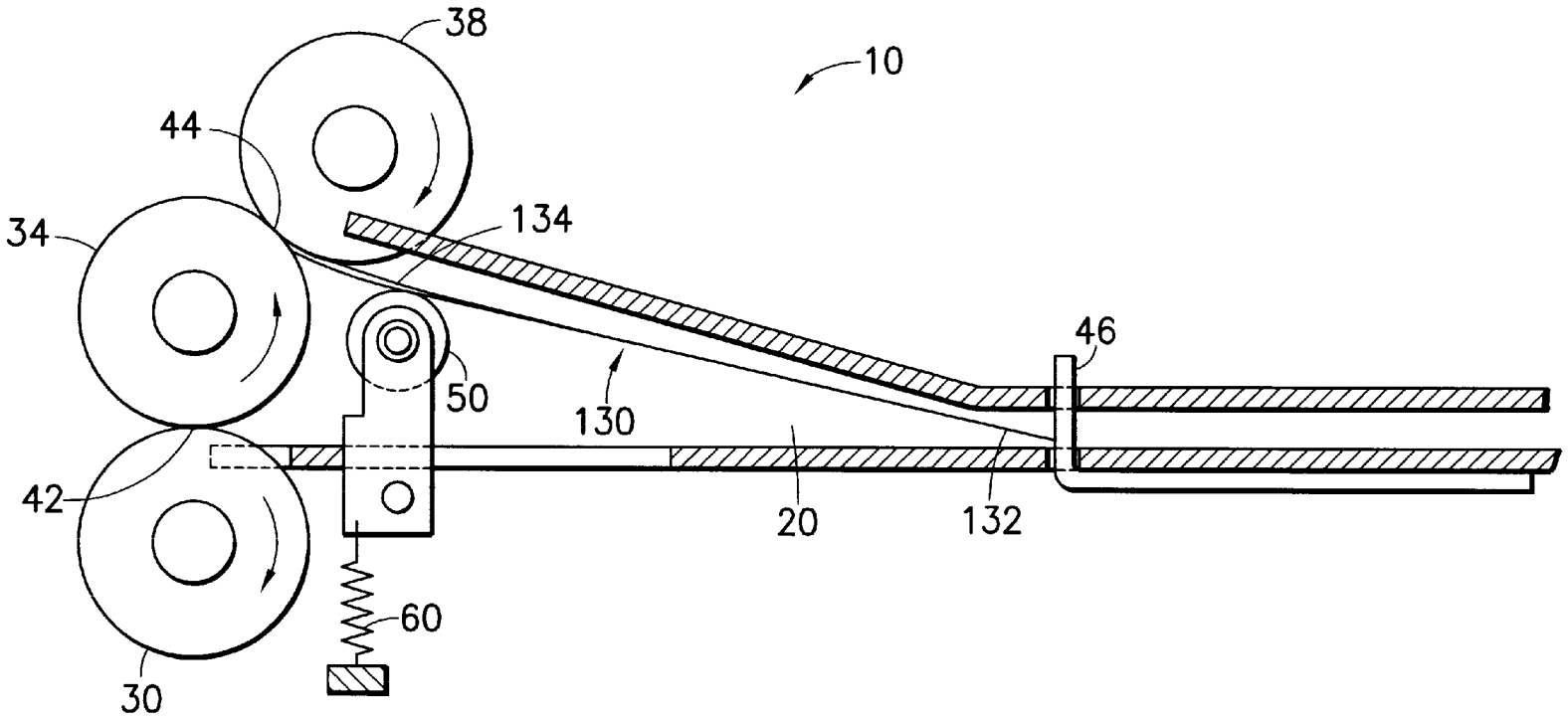
Figure 3E:
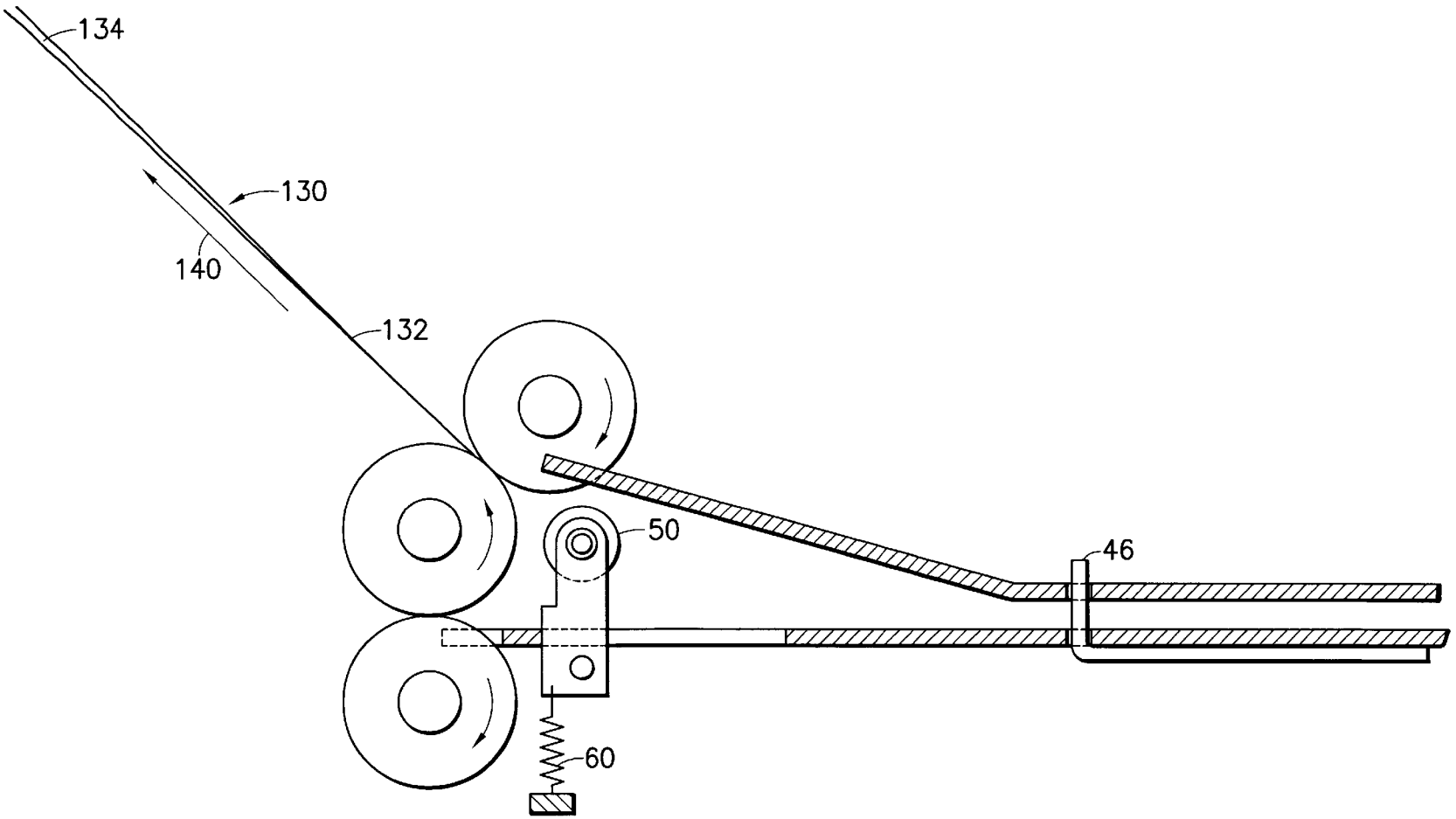

The principle of traveling direction reversal by the path directing apparatus 10 is illustrated in FIGS. 3A through 3D. In FIG. 3A, there is shown a piece of folded material 130 being moved into the turn chute 20 by ingesting nip 42. The folded material 130 is traveling with its folded end 132 first and its open end 134 trailing. Originally, the spring loaded roller 52 is at an upright position. As the leading edge 132 of the folded material 130 is moving along path 150 within the turn chute 20, it depresses the spring loaded roller 50 to a depressed position, substantially away from path 150 as shown in FIG. 3B. Eventually, the leading edge 132 is stopped by the adjustable stop 46 while the trailing edge 132 continues to be moved into the turn chute 20 by the ingesting nip 42. Because the location of the stop 46 is adjusted such that the length of the folded material 130 is slightly greater than the distance between the stop 46 and the ingesting nip 42, the ingested folded material 130 starts to buckle at the trailing edge 134, and the spring loaded roller 50 starts to move back to its original position, as shown in FIG. 3C. Once the trailing edge 134 is disengaged from the ingesting nip 42, with the help of the rotating upper roller 34 and urging force of the returning spring-loaded roller 50, the open end 134 of the folded material 130 is raised. Because the distance between the exiting nip 44 and the stop 46 is also slightly shorter than the length of the folded material 130, the open end 134 is caused by the rotating rollers 34, 38 to be engaged with the exiting nip 44, as shown in FIG. 3D. It is followed that the folded material 130 is moved out of the turn chute 20 along path 140 with the open end 134 leading the folded end 132.

Although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. In a feed path of a folding machine wherein a piece of folded material having a folded end and an open end moves in a traveling direction with the folded end leading the open end, a method of reversing the traveling direction of the folded material, said method comprising the steps of:

(a) Ingesting the folded material by a first nip into a turn chute with the folded end leading the second end;

(b) stopping the ingested folded material at the folded end by a stopper;

(c) disengaging the ingested folded material from the first nip;

(d) causing the open end of the ingested folded material to be engaged in a second nip; and (e) moving the ingested folded material out of the turn chute by the second nip.

2. The method of claim 1 further comprising the step of urging the open end of the ingested folded material to move toward to the second nip prior to causing the open end of the ingested folded material to be engaged in a second nip.

3. The method of claim 2, wherein the folded material has a material length defined by the folded end and the open end and the turn chute has a first length defined by the second nip and the stop and wherein the material length is slightly greater than the first length of the turn chute in order to engage the open end of the ingested folded material after the open end of the ingested folded material is urged toward the second nip.

4. The method of claim 2, wherein said urging is caused by a spring loaded roller.

5. The method of claim 4, wherein the folded material is ingested into the turn chute along a first path and wherein said spring loaded roller is moved substantially away from the first path when the folded material is ingested into the turn chute.

6. The method of claim 1, wherein the first nip is formed by a pair of rollers rotating at opposite directions.

7. The method of claim 1, wherein the second nip is formed by a pair of rollers rotating at opposite directions.

8. The method of claim 1, wherein the first nip is formed by a first roller and a second roller, and the second nip is formed by the second roller and a third roller and wherein the second roller is rotating in a direction opposite to the first and the third rollers.

9. In a feed path of a folding machine wherein a piece of folded material having a folded end and an open end moves in a traveling direction with the folded end leading the open end, a method of reversing the traveling direction of the folded material, said method comprising the steps of:

(a) Ingesting the folded material by a first nip into a turn chute with the folded end leading the second end;

(b) stopping the ingested folded material at the folded end by a stopper;

(c) disengaging the ingested folded material from the first nip;

(d) causing the open end of the ingested folded material to be engaged in a second nip;

(e) moving the ingested folded material out of the turn chute by the second nip; and (f) urging the open end of the ingested folded material to move toward to the second nip prior to causing the open end of the ingested folded material to be engaged in a second nip, wherein the folded material has a material length defined by the folded end and the open end and the turn chute has a first length defined by the second nip and the stop and wherein the material is slightly greater than the first length of the turn chute in order to engage the open end of the ingested folded material after the open end of the ingested folded material is urged toward the second nip; and wherein the turn chute has a second length defined by the first nip and the stop and wherein the material length is slightly greater than the second length of the turn chute so as to cause the folded material to buckle after the folded material has been moved into the turn chute in order to urge the open end of the folded material to moved toward the second nip.

* * * * *